US005505551A

United States Patent [19]

Rutherford

[11] Patent Number: 5,505,551

[45] Date of Patent: Apr. 9, 1996

[54] SHEET SEPARATOR

[76] Inventor: David E. Rutherford, 1758 Carmelo Dr., Carmichael, Calif. 95608-5764

[21] Appl. No.: 287,199

[22] Filed: Aug. 8, 1994

[51] Int. Cl.[6] ..... B41J 11/26

[52] U.S. Cl. ..... 400/621; 225/105

[58] Field of Search ..... 400/621.1, 621; 101/226; 225/3, 4, 5, 93–94, 100, 101, 103–106; 271/52.5

[56] References Cited

U.S. PATENT DOCUMENTS

| | | | |
|---|---|---|---|
| 2,171,769 | 9/1939 | Stolar et al. . | |
| 2,246,228 | 6/1941 | Winter . | |
| 2,639,772 | 5/1953 | Sandberg et al. . | |
| 3,146,927 | 9/1964 | Peterson | 225/100 |
| 3,182,875 | 5/1965 | Fleming | 225/99 |
| 3,191,832 | 6/1965 | Davies | 225/100 |
| 3,741,451 | 6/1973 | Parenti et al. | 225/100 |
| 3,794,228 | 2/1974 | Colwill et al. | 225/105 |
| 3,888,399 | 6/1975 | Hanson et al. | 225/106 |
| 4,069,957 | 1/1978 | Moffitt | 225/5 |
| 4,118,022 | 10/1978 | Rayfield et al. | 270/52.5 |
| 4,222,511 | 9/1980 | Schueler | 225/100 |
| 4,454,973 | 6/1984 | Irvine | 225/100 |
| 4,467,948 | 8/1984 | Deslauriers | 225/97 |
| 4,616,773 | 10/1986 | Kerivan | 225/99 |
| 4,618,085 | 10/1986 | Kimura et al. | 225/100 |
| 5,060,838 | 10/1991 | Gergely, Jr. et al. | 225/100 |
| 5,100,040 | 3/1992 | Kunreuther et al. | 225/100 |
| 5,120,144 | 6/1992 | Lund | 225/100 |
| 5,141,142 | 8/1992 | Ramsey | 225/4 |
| 5,215,383 | 6/1993 | Hilton | 225/103 |
| 5,235,882 | 8/1993 | Rabourn | 225/105 |
| 5,255,008 | 10/1993 | Yoshida | 225/105 |

FOREIGN PATENT DOCUMENTS

| | | | |
|---|---|---|---|
| 808379 | 2/1959 | United Kingdom | 225/100 |
| 1356767 | 6/1974 | United Kingdom | 225/100 |

*Primary Examiner*—Eugene H. Eickholt
*Attorney, Agent, or Firm*—John P. Costello

[57] ABSTRACT

A device for separating individual items from a continuous perforated sheet includes a longitudinal burster for separating longitudinal lines of weakening on a perforated sheet, and a transverse burster for separating transverse lines of weakening on a perforated sheet. The longitudinal burster operates by employing a pair of rollers linked to a pulley device, with belts, the belts causing edge strips on a perforated sheet to diverge, and separate, from the perforated sheet, along its longitudinal lines of weakening. The transverse burster separates transverse lines of weakening by causing a perforated sheet tensioned against the surface of the transverse burster to begin to separate, the separation being completed as the perforated sheet continues to move across the transverse burster.

9 Claims, 11 Drawing Sheets

SHEET SEPARATOR

BACKGROUND OF THE INVENTION

1. Field of the Invention

This invention pertains generally to the separation of individual items, or sheets, from a continuous perforated sheet and, more particularly, to separating individual items, or sheets, from fanfold computer paper and placing the items into a sequentially ordered stack.

2. Description of the Background Art

Various devices have been developed for the separation of individual items, or sheets, from a continuous perforated sheet. U.S. Pat. No. 3,794,228 issued to Colwill et al. discloses a bursting and separating device for continuous forms using adjacent deformable members, which grasp opposite sides of a continuous form, thereby causing the form to separate into sheets at its lines of weakening.

U.S. Pat. No. 2,171,769 issued to Stolar et al., discloses a device which employs a pair of guides for removing edge strips from a perforated sheet, as well as providing a roller which tensions one side of the perforated sheet, causing it to tear at its lines of weakening.

U.S. Pat. Nos. 4,618,085 and 4,454,973 issued to Kimura et al. and Irvine, respectively, disclose sheet separating devices which employ a roller having a raised portion for creating maximum tension at lines of weakening, thereby causing individual items to separate from a continuous sheet.

U.S. Pat. No. 4,529,114 issued to Casper et al., discloses a rotating cam mechanism, which contacts lines of weakening at its highest point of rotation, thereby causing individual items to separate from a continuous sheet.

U.S. Pat. No. 5,120,144 issued to Lund, discloses an edge strip separator which operates by employing a frame for creating a divergence in paths between the edge strips and the central portion of the continuous perforated sheet, thereby causing the strips to separate from the sheet.

Although the patents discussed herein disclose various efficient devices for separating individual items from a continuous perforated sheet, and/or removing edge strips from the same, all of these devices are primarily of an in-line nature, thereby requiring an abundance of space for operation. While many large industrial facilities have enough space to accommodate the prior art devices, many small offices require a more compact device for separating individual items and edge strips from continuous sheets. Moreover, a need exists for a compact sheet separating device which is readily adaptable to most printers designed to operate with continuous perforated sheets. The present invention satisfies these needs, as well as overcomes the deficiencies present in sheet separating devices heretofore developed.

The foregoing patents reflect the state of the art of which the applicant is aware and are tendered with a view toward discharging the applicant's acknowledged duty of candor in disclosing information which may be pertinent to the examination of this application. It is respectfully stipulated, however, that none of these patents teach or render obvious, singly or when considered in combination, applicant's claimed invention.

SUMMARY OF THE INVENTION

The present invention generally pertains to a device for bursting lines of weakening present on continuous perforated sheets and separating edge strips and individual items from continuous perforated sheets.

In a first embodiment, the device incorporates both a transverse burster for bursting transverse lines of weakening on a perforated sheet, and a longitudinal burster, for removing edge strips on a perforated sheet. Both the transverse burster and longitudinal burster are coupled to a frame. A sheet guide which is slidably coupled to the frame, directs the perforated sheet against the transverse burster. In this embodiment, the edge strips are removed, and the perforated sheet is separated into a sequentially ordered stack of individual items, in one process. By processing the perforated sheet completely, this device creates a significant time savings, as office personnel are relieved of the tedious and time-consuming task of tearing off edge strips and separating the individual items by hand. Additionally, this device can operate in conjunction with other devices, for example by operating as a sheet feeder to a laser printer, wherein the invention would operate by separating a continuous perforated sheet into individual items, and subsequently feeding them into a laser printer.

In accordance with one aspect of the first embodiment, the longitudinal burster is coupled transversely to the frame, and the perforated sheet can be fed into the longitudinal burster from a paper container. An efficient longitudinal burster, for purposes of this invention, includes a pair of rollers linked to a pulley device, through a plurality of belts. The belts are arranged at inner and outer locations upon the rollers and pulley device. The rollers and pulley device are coupled transversely to the frame and are spaced far enough apart for accommodating a perforated sheet therebetween. Upon entering the rollers, the outer belts contact the middle portion of the edge strips and pull them in a diverging path, away from the central portion of the perforated sheet, which continues past the pulley device. This divergence of paths causes the edge strips to separate from the central portion of the perforated sheet.

In accordance with another aspect of the first embodiment, the transverse burster, which separates a perforated sheet at its transverse lines of weakening, includes a continuous surface with at least one high point, and one low point. A tensioning mechanism acts to tension the perforated sheet against the high point, of the continuous surface, along its transverse lines of weakening, causing the sheet to separate. The sheet completes its separation at the low point, and a separate individual item is released from the perforated sheet.

Also in accordance with the first embodiment, the sheet guide is preferably shaped in a substantially arcuate manner, which causes the perforated sheet to curl, and double back upon itself, while being processed. The sheet guide, by causing the perforated sheet to double back upon itself, allows this device to function in a small space, and, additionally, helps to guide the perforated sheet into precise contact with the transverse burster. The arcuate sheet guide also aids in causing the perforated sheet to be rendered into a sequentially ordered stack of individual items.

In a second embodiment, especially adaptable for use with a computer printer, it is most preferable to position the longitudinal burster after the transverse burster. In this way, the edge strips are processed and removed last, allowing a user to retract the perforated sheet back into the printer, should the need arise.

In a third embodiment, the device may operate without the longitudinal burster, and function only to separate the individual items along their transverse lines of weakening. This embodiment may be desirable to the user who wishes to separate the individual items, but who also wants to keep the edge strips intact upon each individual item, such as with triplicate invoicing forms, where it is desirable to keep all three copies together. Additionally, this embodiment is useful for separating continuous perforated sheets having only transverse lines of weakening and lacking edge strips. The essential elements of this embodiment include the frame, transverse burster, a sheet guide, and two pairs of rollers traveling at different speeds for creating tension for aiding in the separation of individual items from a perforated sheet.

It is an object of this invention to provide a simple, lightweight, portable and economical device for separating individual items from a continuous perforated sheet.

It is another object of this invention to provide a simple, lightweight, portable, and economical device for separating individual items from a continuous perforated sheet, that is adaptable for use with a computer printer.

It is still another object of this invention to provide a simple, lightweight, portable and economical device for separating individual items from a continuous perforated sheet that is easily adjustable, for readily accommodating perforated sheets having individual items of differing lengths.

A still further object of this invention is to provide a simple, lightweight, portable and economical device for separating individual items from a continuous perforated sheet that is capable of stacking the individual items, while maintaining them in correct sequential order.

Still other objects and advantages of the sheet separator device described herein will become readily apparent to those skilled in this art from the following detailed description, wherein only the preferred embodiments of this device have been shown and described, simply by way of illustration of the best mode contemplated of carrying out the invention. As will be realized, the sheet separator device is capable of other and different embodiments and its several details are capable of modifications in various obvious respects, all without departing from the invention. Accordingly, the drawings and description are to be regarded as illustrative in nature, and not as restrictive.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
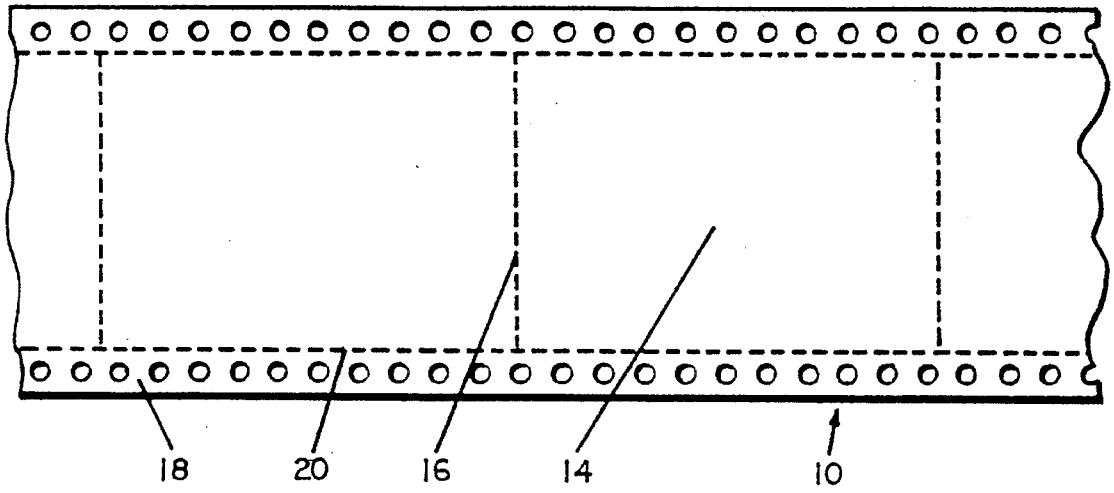
FIG. 1 is a plan view of a continuous perforated sheet, showing edge strips, individual items, and lines of weakening.

Referring more specifically to the drawings, the present invention is designed to accommodate a continuous perforated sheet 10 of the type shown in FIG. 1. Perforated sheet 10 has a central portion 12 comprised of individual items 14, or sheets, joined by transverse lines of weakening 16. Bordering central portion 12 of perforated sheet 10 are edge strips 18 which are joined to perforated sheet 10 by longitudinal lines of weakening 20. Therefore, the present invention is capable of being presented in three main embodiments, but is capable of other variations, as well: (1) An embodiment for bursting both longitudinal 20 and transverse 16 lines of weakening, and thereby removing edge strips 18 and separating individual items 14 and placing individual items 14 in a sequentially ordered stack; (2) a second embodiment similar to the first, but adapted for use with a computer printer; (3) a third embodiment for bursting only transverse lines of weakening 16 on a continuous perforated sheet 10.

In the first embodiment, shown in FIGS. 2 through 6, device 30 may be adapted for bursting both longitudinal lines of weakening 20 and transverse lines of weakening 16 on perforated sheet 10. This embodiment processes perforated sheet 10 completely, as it removes edge strips 18, and separates individual items 14 from perforated sheet 10, and places individual items 14 in a sequentially ordered stack 32. The main operative elements of this embodiment include frame 34, longitudinal burster 36, transverse burster 38, sheet guide 40 and feed rollers 42, 44. Frame 34 provides structural integrity to the other elements, allowing them to function efficiently, and in unison. Additionally, frame 34 provides a location for attaching accessories such as entry tray 46 and exit tray 48, as seen in FIGS. 4A and 4B.

Figure 6:
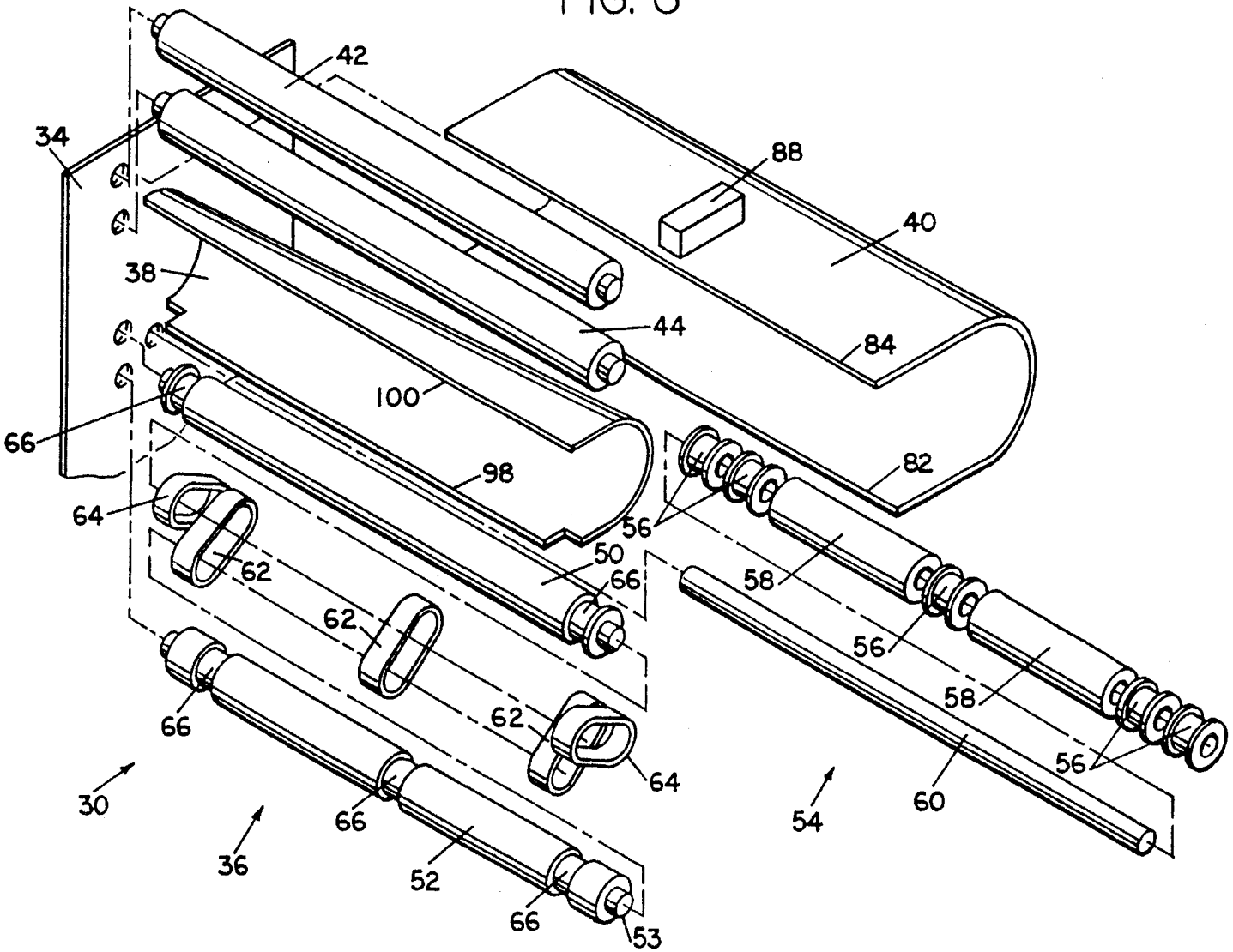
FIG. 6 is an exploded view of the first embodiment of the sheet separator wherein one side of the frame has been removed for improved viewing of the attendant components comprising the sheet separator.
Figure 7A:
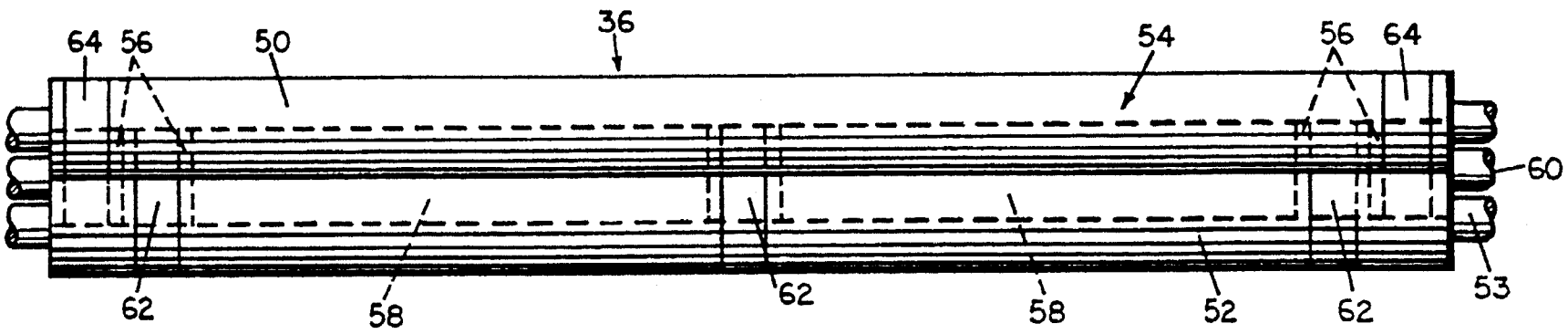
FIG. 7A is a frontal view of the longitudinal burster, illustrating one arrangement of inner and outer belts thereon.
Figure 7B:
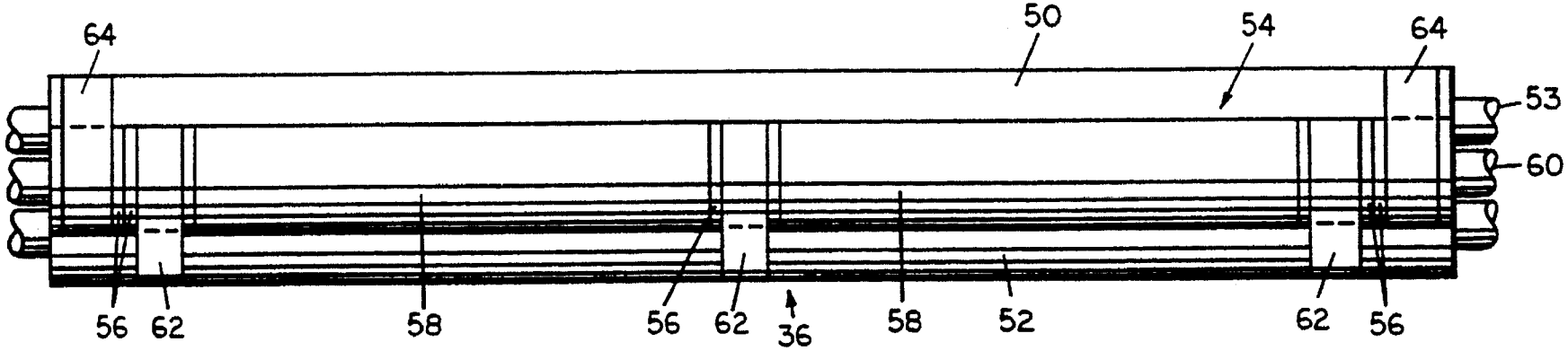
FIG. 7B is a rear view of the longitudinal burster shown in FIG. 7A.
Figure 10:
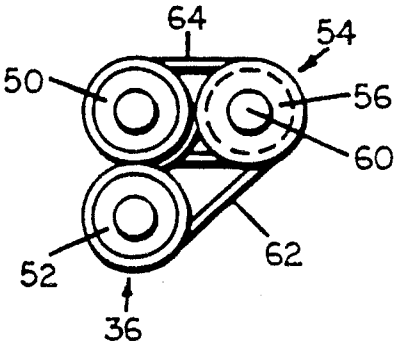
FIG. 10 is a side view of a second alternate arrangement of the rollers and pulley device of the longitudinal burster.
Figure 9:
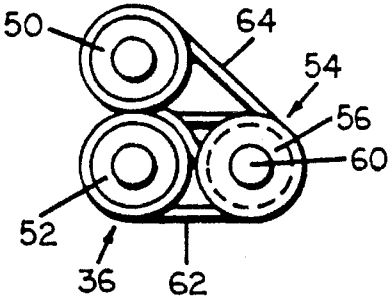
FIG. 9 is a side view of a first alternate arrangement of the rollers and pulley device of the longitudinal burster.
Figure 8:
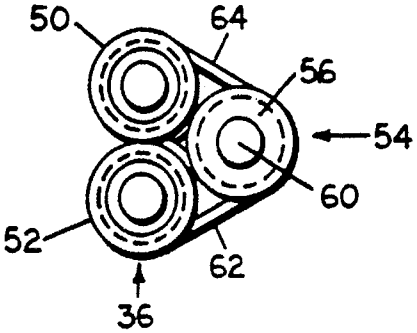
FIG. 8 is a side view of the longitudinal burster shown in FIGS. 7A and 7B.

Referring to FIG. 6, the relation of all the main operative elements attached to frame 34 are clearly illustrated. Longitudinal burster 36 is coupled transversely to frame 34 and includes a first roller 50, a second roller 52, and a pulley device 54. Referring also to FIGS. 7A and 7B, it is seen how second roller 52 is positioned substantially beneath first roller 50 and pulley device 54 is positioned proximate to at least one of first 50 or second 52 rollers. The different possible positionings of pulley device 54 are clearly illustrated in FIGS. 8 through 10. These different positionings do not alter the ability of longitudinal burster 36 to burst longitudinal lines of weakening 20 and remove edge strips 18 from a continuous perforated sheet 10. Longitudinal burster 36 readily accepts perforated sheet 10, without the need for precise registration or alignment of sheet 10.

Referring again to FIG. 6, first 50 and second 52 rollers may have a surface of resilient rubber construction, with sufficient space for receiving perforated sheet 10 therebetween. Rollers 50, 52 include a metal shaft 53 located centrally throughout. Pulley device 54 includes pulleys 56, spacers 58 and a central axle 60 for coupling pulleys 56 and spacers 58, thereto. The space separating pulley device 54 from first 50 and second 52 rollers is again, wide enough for receiving perforated sheet 10 therebetween. Spacers 58 separate pulleys 56, and are of substantially equal diameters, thereby providing a continuous surface for allowing perforated sheet 10 to travel upon.

Figure 11:
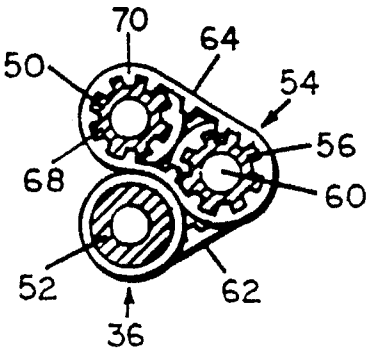
FIG. 11 is a side view of the longitudinal burster adapted for use with toothed belts.

Linking rollers 50, 52 and pulley device 54 of longitudinal burster 36 are a plurality of belts which include inner belts 62 and outer belts 64. Inner 62 and outer 64 belts are preferably seated in recesses 66 located upon rollers 50, 52. Recesses 66 and pulleys 56 prevent inner 62 and outer 64 belts from slipping, or traveling in undesired directions upon rollers 50, 52 and pulley device 54. Additionally, pulleys 56, of pulley device 54, and recesses 66, may incorporate teeth 68 for accommodating a toothed belt 70, of the type shown in FIG. 11.

Figure 2:
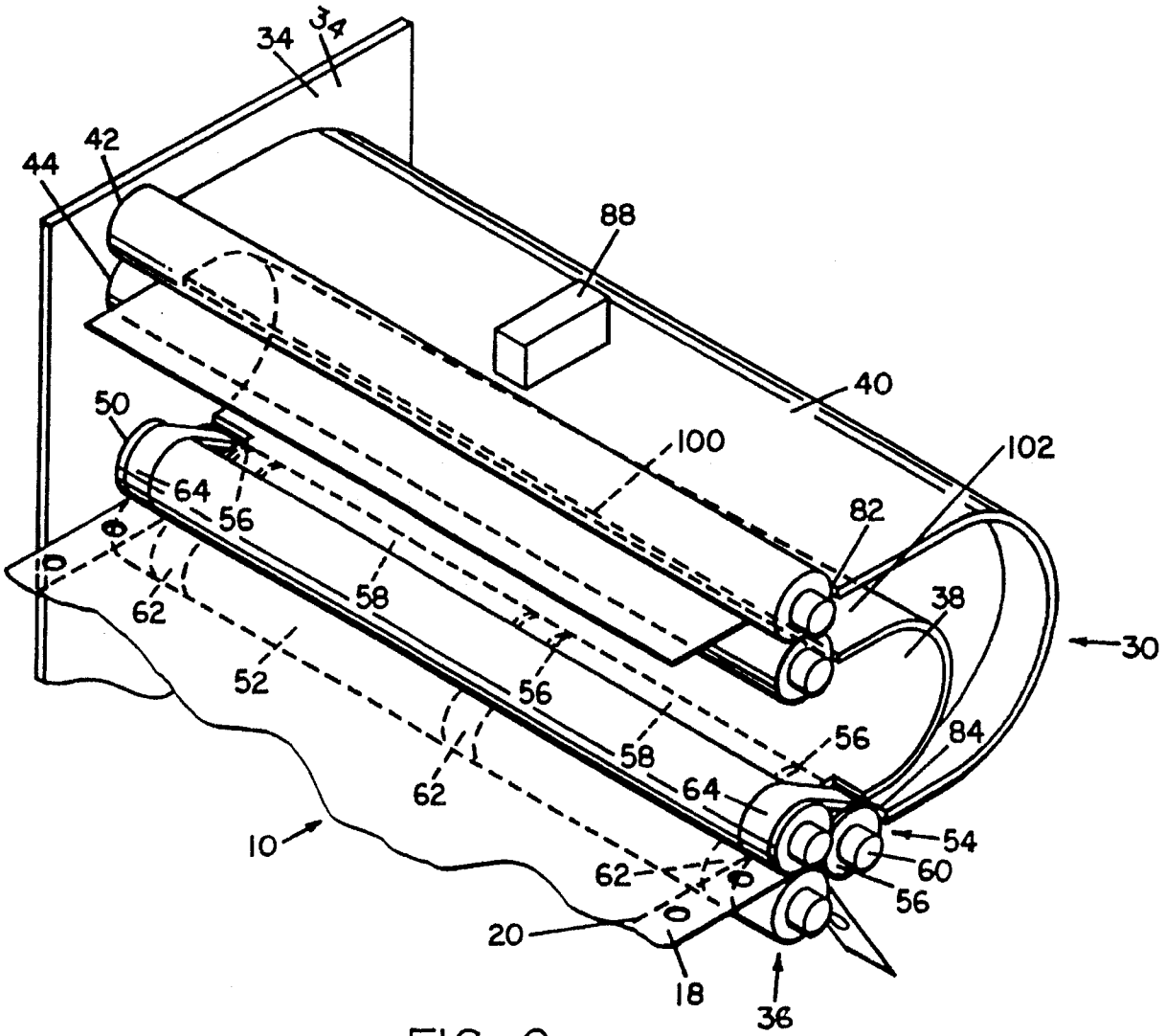
FIG. 2 is a perspective view of the first embodiment of the present invention for bursting both longitudinal lines of weakening and transverse lines of weakening on a continuous perforated sheet of the type shown in FIG. 1. In this perspective view, one side of the frame has been removed for improved viewing of the attendant components comprising the sheet separator.
Figure 3:
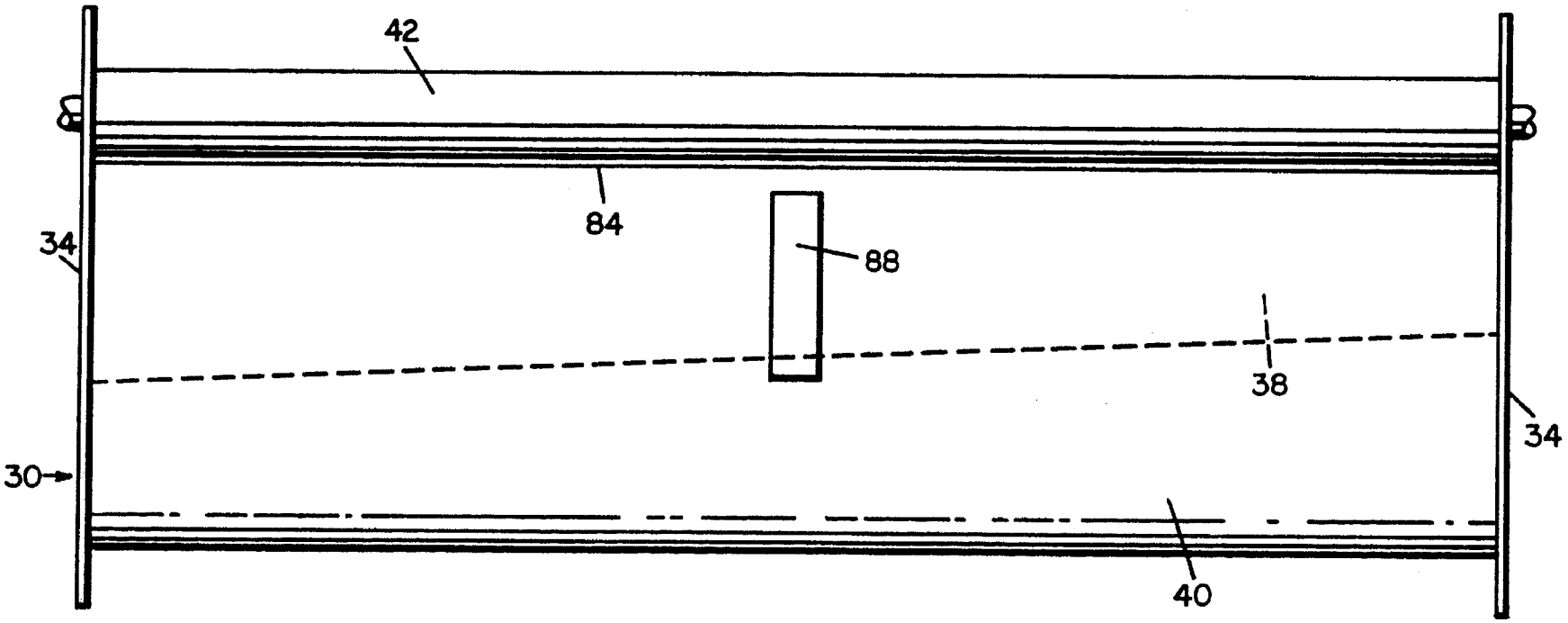
FIG. 3 is a plan view of the first embodiment of the sheet separator.

Recesses 66 additionally position inner 62 and outer 64 belts at an optimum location for bursting longitudinal lines of weakening 20 and thereby removing edge strips 18 from continuous perforated sheets 10. Ideally, as illustrated in FIG. 2, outer belts 64 contact edge strips 18 medially, and cause edge strips 18 to travel in a diverging plane from the central portion 12 of perforated sheet 10, this divergence causing longitudinal lines of weakening 20 to burst.

The direction of divergence taken by edge strips 20 and the central portion 12 of perforated sheet 10 is determined by the positioning of belts 62, 64. Here as additionally shown in FIGS. 4A and 12A, the two outer belts 64 would align with edge strips 18, medially, and connect first roller 50 with pulley device 54. The three inner belts 62 would align proximate longitudinal lines of weakening 20 and in the center of central portion 12 of sheet 10 and inner belts 62 would connect second roller 52 with pulley device 54. In this arrangement of outer belts 64, edge strips 18 would be driven in a downward plane, while the central portion 12 of perforated sheet 10 would continue in a substantially horizontal plane. The relative plane taken by edge strips 18 is shown by arrow 72, while the relative plane taken by the central portion 12 of perforated sheet 10 is shown by numeral 74 in the first embodiment in FIG. 4A and in the second embodiment of the invention in FIG. 12A.

Figure 4A:
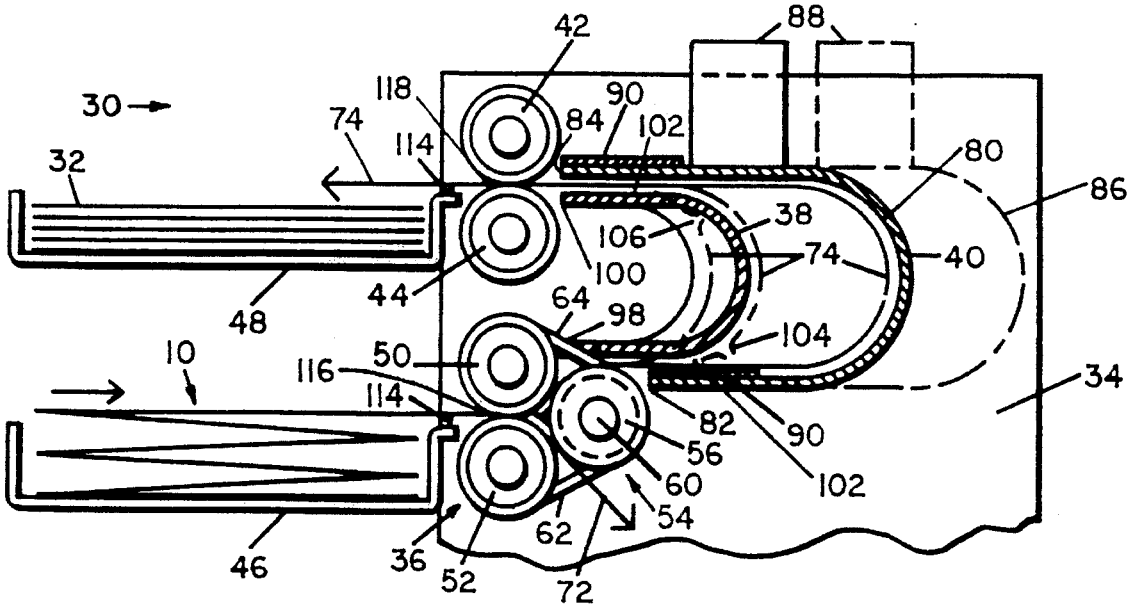
FIG. 4A is a side view of the first embodiment of the sheet separator.
Figure 4B:
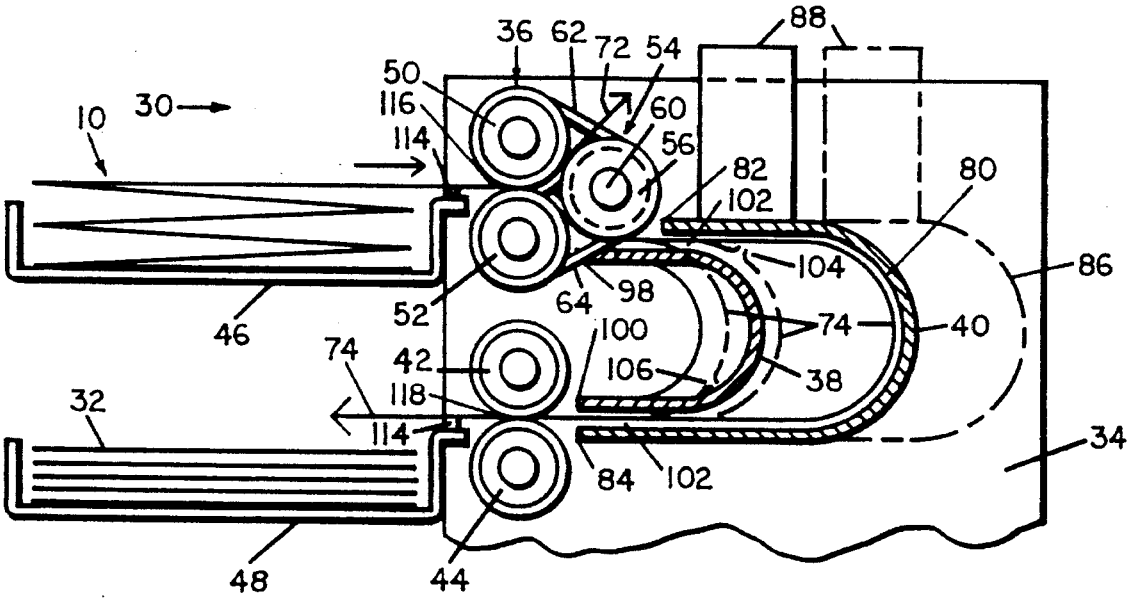
FIG. 4B is a side view of the sheet separator shown in FIG. 4A, wherein the longitudinal burster, feed rollers, inner and outer belts, and paper trays have been repositioned.
Figure 5:
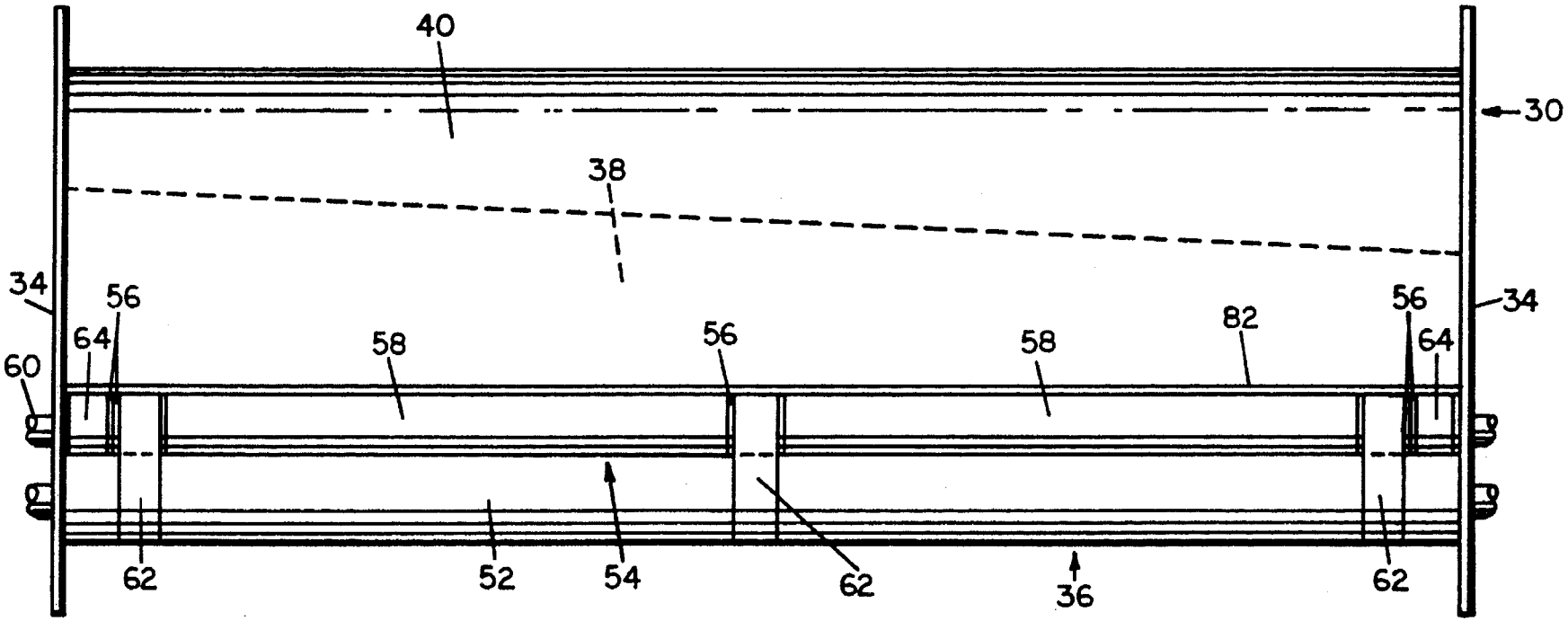
FIG. 5 is a bottom view of the first embodiment of the sheet separator.
Figure 12A:
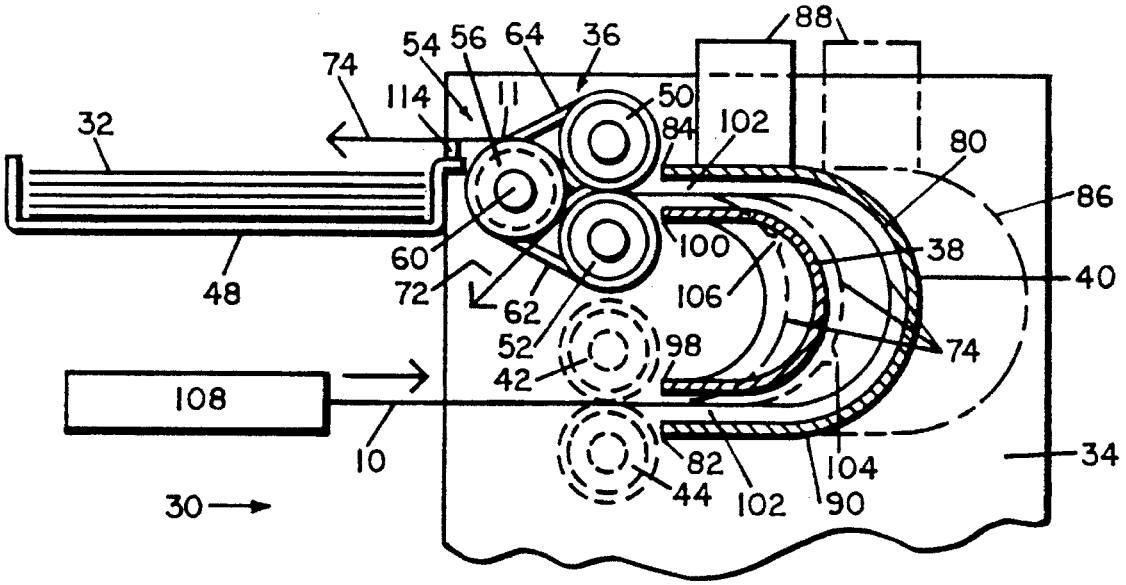
FIG. 12A is a side view of the second embodiment of the sheet separator, adapted for used with a computer printer.
Figure 12B:
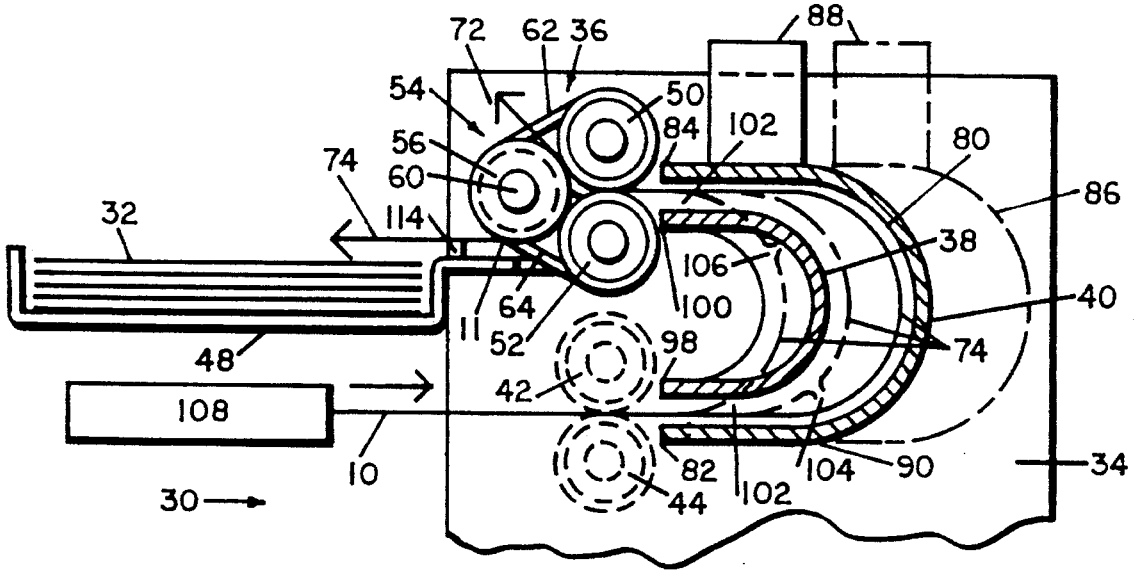
FIG. 12B is a side view of the second embodiment shown in FIG. 12A, wherein the inner and outer belts have been repositioned.

Likewise, as alternately illustrated in FIGS. 4B and 12B, the three inner belts 62 would align proximate longitudinal lines of weakening 20 and in the center of central portion 12 of sheet 10 as before, but, instead, outer belts 64 would connect second roller 52 with pulley device 54. In this arrangement of outer belts 64, edge strips 18 would be driven in an upward plane while the central portion 12 of perforated sheet 10 would continue in a substantially horizontal plane, as before. Again, in FIGS. 4B and 12B, the direction taken by edge strips 18 is shown by arrow 72 and the direction taken by central portion 12 of sheet 10 is shown by numeral 74.

Figure 13:
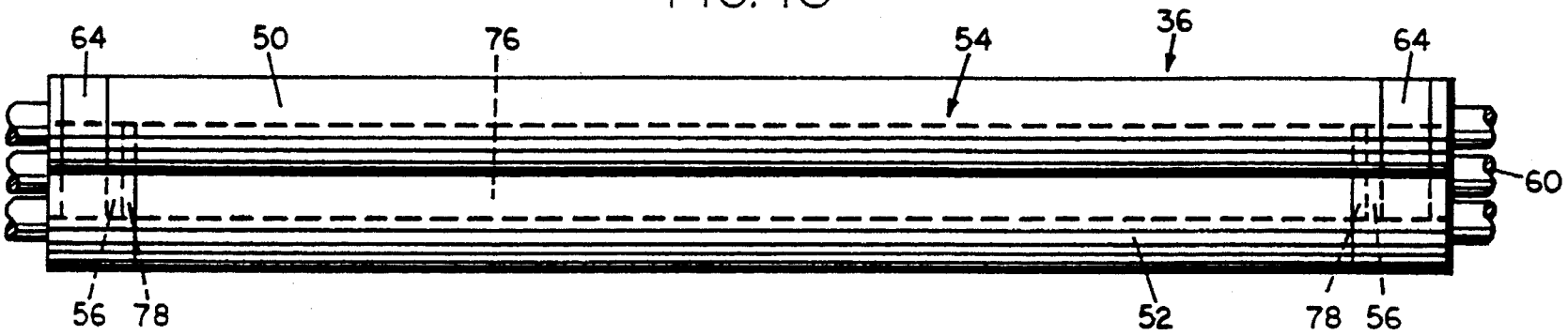
FIG. 13 is a frontal view of the longitudinal burster, wherein the inner belts have been replaced by a single, wide, inner belt.

FIG. 13 illustrates an alternate arrangement of belts, as well as pulleys. In this arrangement, the three inner belts 62 and pulleys 56 have been replaced by a single, wide, central belt 76, and wide pulley 78, extending substantially the distance between longitudinal lines of weakening 20. This arrangement eliminates the need for spacers 58 and reduces the number of inner belts 62 and pulleys 56 required to make longitudinal burster 36 operate, thereby reducing the complexity of longitudinal burster 36.

Figure 14:
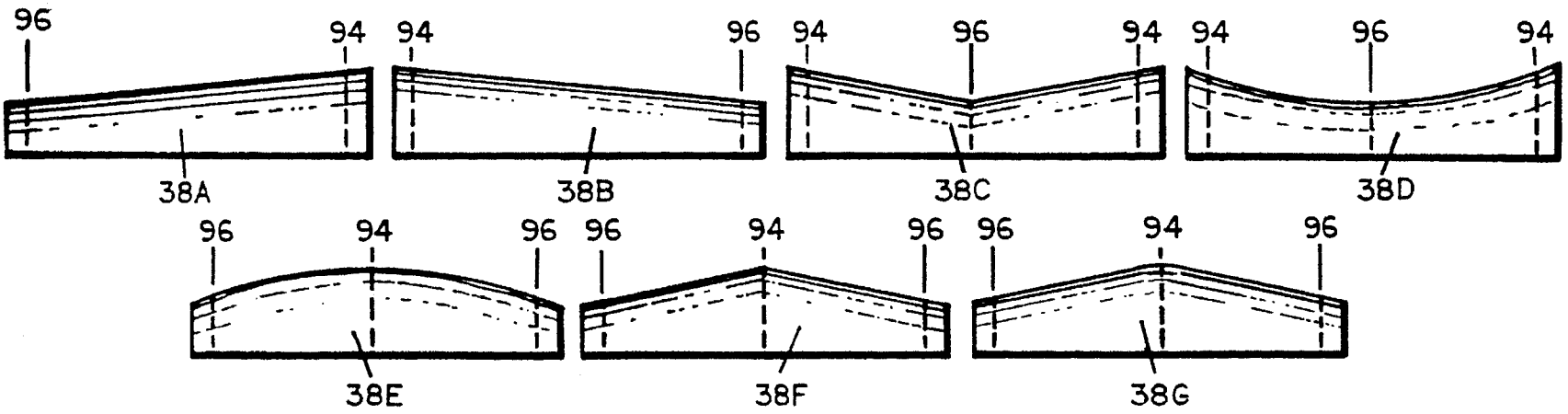
FIG. 14 is a plan view of possible shapes for the transverse burster.

Referring additionally to FIG. 14, the elements of the sheet guide 40 and transverse burster 38 can be examined. Sheet guide 40 may be any surface which guides a continuous perforated sheet 10 across transverse burster 38 and into feed rollers 42, 44, but it is preferable that sheet guide 40 be of an arcuate shape, for causing perforated sheet 10 to double back upon itself, thereby creating a space savings, and allowing device 30 to be of a compact nature. Additionally, the arcuate shape of sheet guide 40 aids in stacking individual items 14 in a sequentially ordered stack 32. Sheet guide 40 preferably has a smooth inner surface 80 for allowing perforated sheet 10 to travel easily.

As seen in the first embodiment shown in FIG. 4A, the leading edge 82 of sheet guide 40 extends adjacent to and parallel with pulley device 54, whereas the trailing edge 84 lies adjacent to and parallel with feed roller 42. Sheet guide 40 is preferably made to be slidably adjustable, in a horizontal direction, for purposes of accommodating perforated sheets 10 having individual items 14 of differing lengths. This slidable feature, illustrated by dotted lines 86, allows any size of individual items 14 to contact transverse burster 38, precisely at transverse lines of weakening 16, thereby avoiding tears at undesirable locations. Means for moving sheet guide 40, horizontally, are provided by a handle 88, or else automatic means of sliding sheet guide 40, may be incorporated into the invention.

Guide spacers 90 extend a substantial distance and serve to fill any gap created by the adjustment of sheet guide 40. Upon exiting from sheet guide 40, feed rollers 42, 44 aid in placing perforated sheet 10 into exit tray 48. Feed rollers 42, 44, unlike rollers 50, 52 preferably have a continuous surface absent any recesses 66.

Transverse burster 38 includes a continuous surface 92 with at least one high point 94 and one low point 96 as is seen by the possible variations of transverse burster, 38A through 38G, in FIG. 14. Of these variations, 38A and 38B are preferable. High point 94 and low point 96 are crucial for aiding in the separation of transverse lines of weakening 16. From a side view as seen in FIG. 4A transverse burster 38 is arcuately shaped, like sheet guide 40, only of smaller diameter. Transverse burster 38 is located inside sheet guide 40 and its leading edge 98 aligns proximate to and parallel with first roller 50, while its trailing edge 100 lies proximate to and parallel with feed roller 44. A gap 102 exists between sheet guide 40 and transverse burster 38 to allow for the passage of perforated sheet 10 therebetween.

The operation of transverse separation performed by device 30 is best illustrated by referring to FIGS. 14, 4A and 4B. Feed rollers 42, 44, and longitudinal burster 36 work in conjunction with transverse burster 38 to achieve transverse separation. In operation, longitudinal burster 36 feeds perforated sheet 10 into sheet guide 40. Tensioning mechanism, not shown, which may be a differing gear ratio coupled to longitudinal burster 36 and feed rollers 42, 44, causes feed rollers 42, 44 to travel at a faster rate of speed than longitudinal burster 36, thereby causing a portion of perforated sheet 10 being processed, to travel at a faster rate of speed than the remaining portions. Longitudinal burster 36, tensioning mechanism, and feed rollers 42, 44 are driven by a drive element, such as an electric motor, not shown.

The acceleration of perforated sheet 10 by tensioning mechanism, causes sheet 10 to be tensioned upon transverse burster 38, causing sheet 10 to tear upon the high point 94 of continuous surface 92, along its transverse lines of weakening 16. Perforated sheet 10 continues to tear until low point 96 is reached, and a separate individual item 14 is released. The start and termination of the tearing of perforated sheet 10 are shown in FIGS. 4A and 4B by points 104 (start) and 106 (termination), respectively.

In the second embodiment adapted for use with a computer printer 108 as shown in FIGS. 12A and 12B, it is preferable for longitudinal burster 36 to be positioned after transverse burster 38. Here, edge strips 18 are removed only after perforated sheet 10 has been subjected to transverse separation. Once transverse separation has occurred, the unseparated portions of perforated sheet 10 can be retracted into printer 108, with edge strips 18 remaining intact. A notable feature of this embodiment is that feed rollers 42, 44 (shown in phantom) may be eliminated if an equivalent mechanism exists in printer 108 for feeding perforated sheet 10 into device 30. As ancillary to this embodiment, device 30 can be incorporated as an integral part of printer 108.

Figure 15:
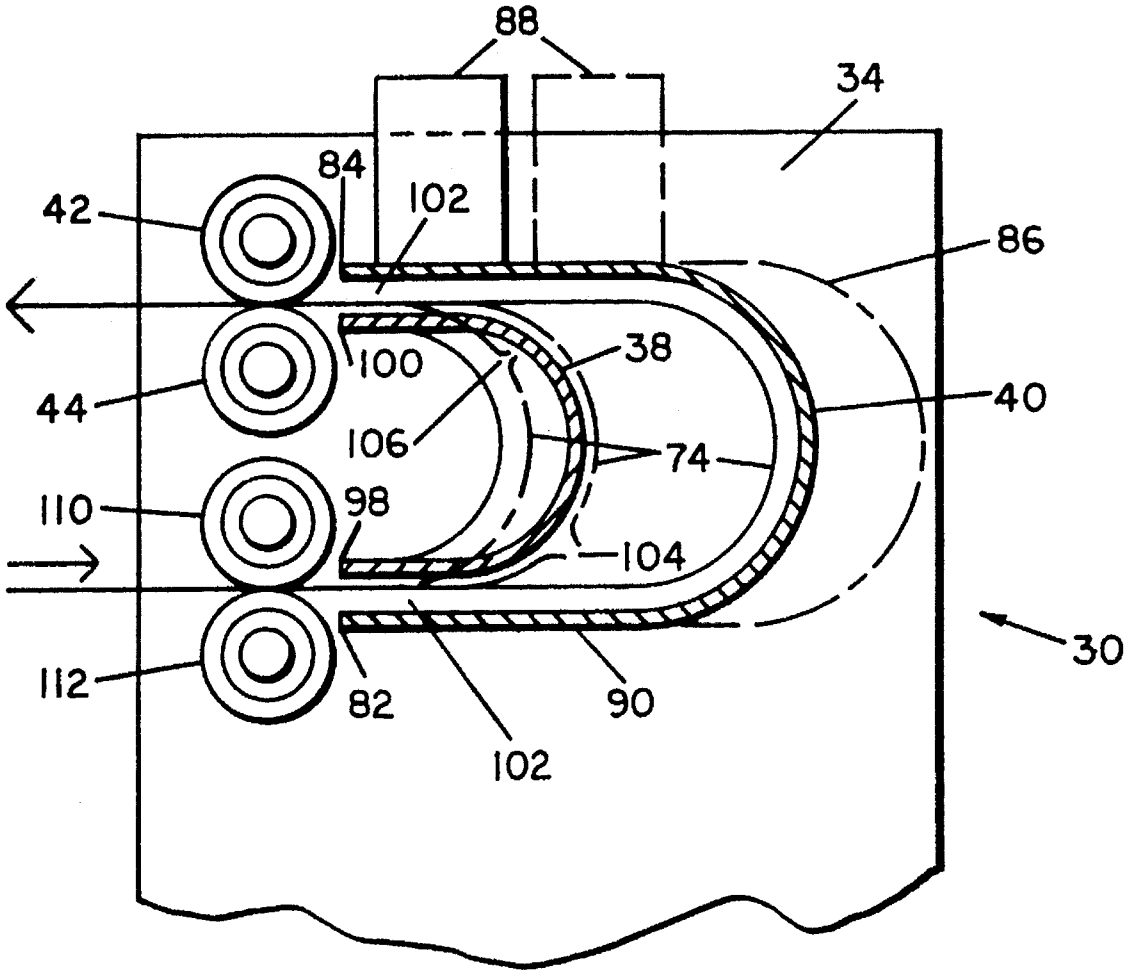
FIG. 15 is a side view of a third embodiment of the present invention for bursting transverse lines of weakening and separating individual items from a continuous perforated sheet.

In a third embodiment, shown in FIG. 15, device 30 may operate without longitudinal burster 36, working only to separate individual items 14 along their transverse lines of weakening 16. This embodiment may be desirable to the user who wishes to separate individual items 14, but who also wants to keep the edge strips 18 intact upon each individual item 14, such as with triplicate invoicing forms, where it is desirable to keep all three copies together. Additionally, this embodiment is ideal for separating a perforated sheet 10 having only transverse lines of weakening 16 and lacking edge strips 18. In accordance with this embodiment of the invention, frame 34 provides support for all the attendant components which include transverse burster 38, horizontally adjustable sheet guide 40, feed rollers 42, 44, 110, 112, tensioning mechanism and drive component. Two pairs of feed rollers 42, 44 and 110, 112, rotating at different speeds, and coupled to a tensioning mechanism, operate to insure that perforated sheet 10 is tensioned against transverse burster 38. Sheet guide 40 is again, preferably adjustable for accommodating individual items 14 of differing sizes. While this embodiment lacks a longitudinal burster 36, the functioning of any remaining elements is as previously described.

As an added feature to the embodiments previously described, microswitches 114 may operate as a switching mechanism for automatically switching device 30 on and off. As shown in FIGS. 4A, 4B, for example, a pair of microswitches 114, one immediately preceding the point of entry 116, the other immediately following the point of exit 118, allow the main switching element, not shown, to remain closed continuously. The actual operation time is limited to the interval between the initial insertion of continuous sheet 10 and the exiting of the final individual item 14. This automatic shut-off feature allows an operator to insert perforated sheet 10 and return at his or her leisure to pick up individual items 14. Stack 32 consists of individual items 14 arranged in sequential order, thus eliminating the need to manually rearrange them.

Other variations of this invention are possible. For example, inner belts 62 may be eliminated if comparable means are substituted. Also, a hole punch in the form of a removable attachment may be added to the present invention, wherein a wheel with a cylindrical punch creates holes in individual items 14 to allow their storage in a typical ring binder, or the like. Furthermore, a door may be added to device 30, the door being left open to allow edge strips 18 to exit directly into an exterior receptacle, or allowing edge strips 18 to be temporarily stored by closing the door. Alternately, a removable drawer may be incorporated into the present invention for the storage and subsequent removal of edge strips 18.

Accordingly, it will be seen that this invention provides for a sheet separator device for processing continuous perforated sheets. This device processes a continuous perforated sheet by removing edge strips as well as by separating individual items from a perforated sheet. This device creates a significant time savings in an office environment by alleviating office personnel from the tedious and time consuming task of removing edge strips and separating individual items, by hand.

Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. An apparatus for separating parallel strips from a continuous perforated sheet along longitudinal lines of weakening, comprising:

(a) a frame;

(b) a first roller;

(c) a second roller positioned substantially beneath said first roller;

(d) said rollers being of substantially equal diameters;

(e) a pulley means located proximate to at least one of said first roller or said second roller;

(f) said pulley means comprising a single shaft with a plurality of pulleys thereon;

(g) a plurality of belts linking said rollers and said pulley means;

(h) said rollers and said pulley means coupled transversely to said frame;

(i) said belts forcing said parallel strips to separate along said longitudinal lines of weakening.

2. The apparatus of claim 1 further comprising a plurality of recesses in said rollers, each of said recesses aligning with a different one of said belts.

3. The apparatus of claim 1 wherein said pulleys are separated by a spacer or spacers where necessary.

4. An apparatus for bursting transverse lines of weakening of a perforated sheet, comprising:

(a) a first pair of rollers;

(b) a transverse burster having a leading edge, a trailing edge, and an arcuate portion positioned between said leading and trailing edges, said arcuate portion having a high point and a low point;

(c) a second pair of rollers;

(d) said second pair of rollers being driven at a speed greater than said first pair of rollers so as to pull said lines of weakening against said arcuate portion of said transverse burster, said perforated sheet tearing upon moving from said high point to said low point; and (e) an arcuately shaped guide means for guiding said perforated sheet, said guide means slidably positioned in front of said transverse burster.

5. A device for separating individual items from a continuous perforated sheet having edge strips, comprising:

(a) a frame;

(b) longitudinal bursting means for bursting longitudinal lines of weakening along said edge strips, said longitudinal bursting means coupled to said frame;

(c) a transverse burster having a leading edge, a trailing edge, and an arcuate portion positioned between said leading and trailing edges, said arcuate portion further comprising a continuous surface having a high point and a low point, said transverse burster coupled to said frame; and (d) guide means for guiding said perforated sheet.

6. The device as recited in claim 5, further including tensioning means for tensioning said perforated sheet upon said transverse bursting means.

7. The device as recited in claim 5, wherein said longitudinal bursting means further comprises:

(a) a first roller;

(b) a second roller positioned substantially beneath said first roller;

(c) a pulley means located proximate to at least one of said first or second rollers;

(d) said rollers and said pulley means coupled transversely to said frame;

(e) a plurality of belts linking said rollers and said pulley means;

(f) said belts forcing said edge strips to diverge and separate along said longitudinal lines of weakening.

8. A device for separating individual items from a continuous perforated sheet having edge strips, comprising:

(a) a frame;

(b) longitudinal bursting means for bursting longitudinal lines of weakening along said edge strips, said longitudinal bursting means coupled to said frame;

(c) transverse bursting means for bursting transverse lines of weakening, said transverse bursting means coupled to said frame; and (d) guide means for guiding said perforated sheet, said guide means shaped substantially arcuate, said guide means slidably coupled to said frame.

9. In combination, a device for separating individual items from a continuous perforated sheet having edge strips, comprising:

(a) a frame;

(b) longitudinal bursting means for bursting longitudinal lines of weakening along said edge strips comprising, (i) a first roller;

(ii) a second roller positioned substantially beneath said first roller;

(iii) a pulley means located proximate to at least one of said first or second rollers;

(iv) said rollers and said pulley means coupled transversely to said frame;

(v) a plurality of belts linking said rollers and said pulley means;

(vi) said belts forcing said edge strips to diverge and separate along said longitudinal lines of weakening.

(c) transverse bursting means for bursting transverse lines of weakening comprising, (i) a continuous surface, said surface having at least one high point and one low point;

(d) tensioning means for tensioning said perforated sheet, said tensioning means causing said perforated sheet to tear at said high point upon said continuous surface at said transverse lines of weakening, said sheet continuing to tear upon moving across said continuous surface;

(e) guide means for guiding said perforated sheet, said guide means shaped substantially arcuate;

(f) said guide means slidably coupled to said frame.

* * * * *